United States Patent [19]

Quast et al.

[11] Patent Number: 4,717,083

[45] Date of Patent: Jan. 5, 1988

[54] HAMMER ASSEMBLY FOR A ROTARY MATERIAL CRUSHER

[76] Inventors: Roger H. Quast, 7040 Lake Ellenor Dr., Suite 117, Orlando, Fla. 32809; Axel W. Orphall, 200 King Richard Dr., McMurray, Pa. 15317

[21] Appl. No.: 23,995

[22] Filed: Mar. 9, 1987

Related U.S. Application Data

[63] Continuation of Ser. No. 574,699, Jan. 27, 1984, abandoned.

[51] Int. Cl.[4] ..... B02C 13/28

[52] U.S. Cl. ..... 241/197; 241/300

[58] Field of Search ..... 241/191, 192, 195, 197, 241/294, 300, 194

[56] References Cited

U.S. PATENT DOCUMENTS

| | | | |
|---|---|---|---|
| 1,947,784 | 2/1934 | Armstrong | 241/194 |
| 2,310,758 | 2/1943 | Werner et al. | 241/197 X |
| 2,558,107 | 6/1951 | Smith | 241/197 X |
| 3,236,463 | 2/1966 | Ratkowski | 241/197 |
| 3,545,691 | 12/1970 | Arsenault | 241/197 |
| 3,829,032 | 8/1974 | Schrimper | 241/197 |
| 3,838,826 | 10/1974 | Wallace et al. | 241/197 |
| 3,929,296 | 12/1975 | Stoeber | 241/197 |
| 4,046,327 | 9/1977 | Cranor | 241/197 |
| 4,129,262 | 12/1978 | Lowry | 241/197 |

FOREIGN PATENT DOCUMENTS

| | | |
|---|---|---|
| 231016 | 3/1925 | United Kingdom . |
| 373289 | 5/1932 | United Kingdom . |
| 692689 | 6/1953 | United Kingdom . |
| 2078134A | 1/1982 | United Kingdom . |

*Primary Examiner*—Mark Rosenbaum

*Attorney, Agent, or Firm*—Armstrong, Nikaido, Marmelstein & Kubovcik

[57] ABSTRACT

A hammer assembly for attachment to a rotor of a rotary material crusher is disclosed. The hammer assembly includes a hammer member rigidly connected to the rotor and an extension of the hammer member having a longitudinal axis disposed parallel and spaced relative the axis of rotation of the rotor. The extension has a uniform transverse cross-sectional configuration along the length of the extension. A cap means is removably connected to the extension for crushing the material on rotation of the rotor, the cap defining an undercut portion which cooperates with the extension for locking the cap adjacent the hammer member.

7 Claims, 7 Drawing Figures

HAMMER ASSEMBLY FOR A ROTARY MATERIAL CRUSHER

This application is a continuation of application Ser. No. 574,699 filed Jan. 27, 1984, and now abandoned.

FIELD OF THE INVENTION

This invention relates to a hammer assembly for attachment to a rotor of a rotary material crusher. More specifically, this invention relates to a hammer assembly having a reversible cap for crushing rocks and the like.

BACKGROUND OF THE INVENTION

In view of the high wear factors imposed upon rock crushing machinery, many proposals have been made in an attempt to increase the life of the rock engaging components of such rock crushers.

Traditionally operators of rock crushing machinery have sought to overcome the gradual loss of efficiency due to wear of the rock engaging components by hard face welding metal to the rock engaging components.

When such rock crushers are used for crushing wet and abrasive lime rock, heavy wear factors are imposed on the impact crusher hammers, which necessitates frequent hard face welding to the impact crusher hammers sometimes on a daily basis. In practice four to ten hours a day have been spent by welders endeavoring to maintain the efficiency of such rock crushing machinery. Not only is this welding process an extremely expensive operation, but this operation also involves considerable danger in that it is often necessary for the welder to work in a hostile environment and in cramped locations adjacent the impact crusher hammers.

In order to eliminate this costly and potentially dangerous problem, rock crushing machinery has been produced that enables the easy replacement of rock engaging components. A capping system to replace stock hammers has totally eliminated the need for hard face welding. Such caps for attachment to the hammer carrier are removably fastened to the hammer carrier, and when the caps become worn it is a relatively easy operation to remove the cap and replace the same with new caps.

U.S. Pat. No. 3,838,826 to J. M. Wallace, et al. assigned to Capeletti Brothers, Inc. teaches a rotor having diametrically-opposed hammer carriers. Each of the hammer carriers defines a plurality of dovetail undercut grooves disposed substantially tangentially relative the axis of rotation of the rotor. A plurality of hammer caps, each having a dovetail extension extending therefrom, are able to be slid tangentially relative the hammer carrier, such that the extension and groove cooperate to lock the hammer cap in position relative the hammer carrier. Fastening means are used to rigidly secure the hammer cap relative the hammer carrier.

While the proposal of Wallace, et al. greatly increased the speed with which a rotary crusher could be serviced, this proposal still left a need in the art of a hammer cap that could easily be reversed such that when wear occurred on one of the rock engaging faces of the cap, the cap could be reversed, and thus the considerable expense of replacing a set of hammer caps could be avoided, or at least halved.

The hammer assembly of the present invention overcomes the aforementioned inadequacies of the prior art devices by providing a reversible cap that can easily be oriented through 180° to present a second hard face into a position for crushing material on rotation of the rotor. It is the primary object of the present invention to provide a rotary rock crusher that overcomes the aforementioned inadequacies of the prior art devices and provides an improvement which significantly contributes to the reliability and the ease with which a hammer assembly for a rotary rock crusher may be serviced.

Another object of the invention is the provision of a reversible cap for fastening to the hammer member, such that the reversible cap may be oriented through 180°.

Another object of the invention is the provision of a hammer assembly which greatly reduces the cost of replacement of the material engaging caps.

Another object of the present invention is the provision of a reversible cap for a hammer assembly which avoids the time-consuming and dangerous operation of welding that has been employed to hard face impact crusher hammers.

Another object of the present invention is the provision of a reversible cap for a hammer assembly which is quick and simple to install.

A further object of the present invention is the provision of a reversible cap for a rotary material crusher which may be retrofitted to a plurality of conventional primary impacters.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention within the scope of the disclosure. Particularly with regard to the use of the invention disclosed herein, it should not be construed as being limited to hammer assemblies for the attachment to the rotor of a rotary material crusher, but should include reversible caps for application to any material crushing apparatus and the like.

SUMMARY OF THE INVENTION

The hammer assembly of the present invention is defined by the appended claims with a specific embodiment shown in the attached drawings. For the purpose of summarizing the invention, the invention relates to a hammer assembly for attachment to a rotor of a rotary material crusher or the like. The hammer assembly includes a hammer member for rigid connection to the rotor. The hammer member has an extension extending from the hammer member. The extension has a longitudinal axis parallel with and spaced from the axis of rotation of the rotor. The extension has a uniform cross-sectional configuration along the length of the extension. A cap is removably connected to the extension for impacting and crushing the material on rotation of the rotor. The cap has an undercut portion which cooperates with a dove tail on the extension for locking the cap on the extension.

In a more specific embodiment of the invention, the extension has a longitudinal channel which has a longitudinal axis extending parallel to the axis of rotation of the rotor. The extension has a plurality of first bores which extend through the extension, each of the first bores having a longitudinal axis extending substantially perpendicular to the extension within such extension. The extension further includes first fastening means which extend through the first bores for fastening the hammer member to the rotor.

A plurality of second bores, each of which extends through the cap are disposed so that the longitudinal axes of the second bores are substantially parallel to the first bores.

The cap further includes a first and a second hard face which extend respectively along a first and a second portion of the outer surface of the cap, the first and the second hard faces, respectively, being disposed parallel relative the axis of rotation of the rotor. The extension has a plurality of third bores, each of which are disposed transverse relative the extension and substantially parallel relative to the axis of rotation of the rotor, such that when the cap is locked to the extension the third bores are in alignment with and correspond with the second bores. The third bores extend through the the extension and extension dove tail. A second fastening means extends through the second and third bores for fastening the cap to the extension. The cap first and second hard faces are reversed when the cap means is rotated through 180° about the longitudinal axis of the second and third plurality of bores.

In a preferred embodiment of the invention, each of the second bores is disposed substantially midway between the first and the second hard faces of the cap so that when the cap means is rotated through 180° about the longitudinal axis of the second and third plurality of bores the positions occupied by the first and the second hard faces relative to the extension are interchanged.

The undercut portion defined by the cap means is of the same general cross-sectional configuration as the dove tail on the extension, but is of slightly greater dimensions so that the cap means may be slid longitudinally relative to the extension to slide the cap into locking engagement with the extension. In the preferred embodiment of the present invention, a pair of cap means cooperates with each of the hammer members such that the cap means may be installed by sliding the cap means longitudinally and parallel relative the axis of rotation of the rotor. Also in the preferred embodiment of the present invention, the extension and the undercut portion are both of uniform dovetail cross-sectional configuration along the length thereof.

The foregoing has outlined rather broadly the more pertinent and important features of the present invention in order that the detailed description of the invention that follows may be better understood so that the present contribution to the art can be more fully appreciated. Additionally, features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through the several views of the drawings.

DETAILED DESCRIPTION

Figure 1:
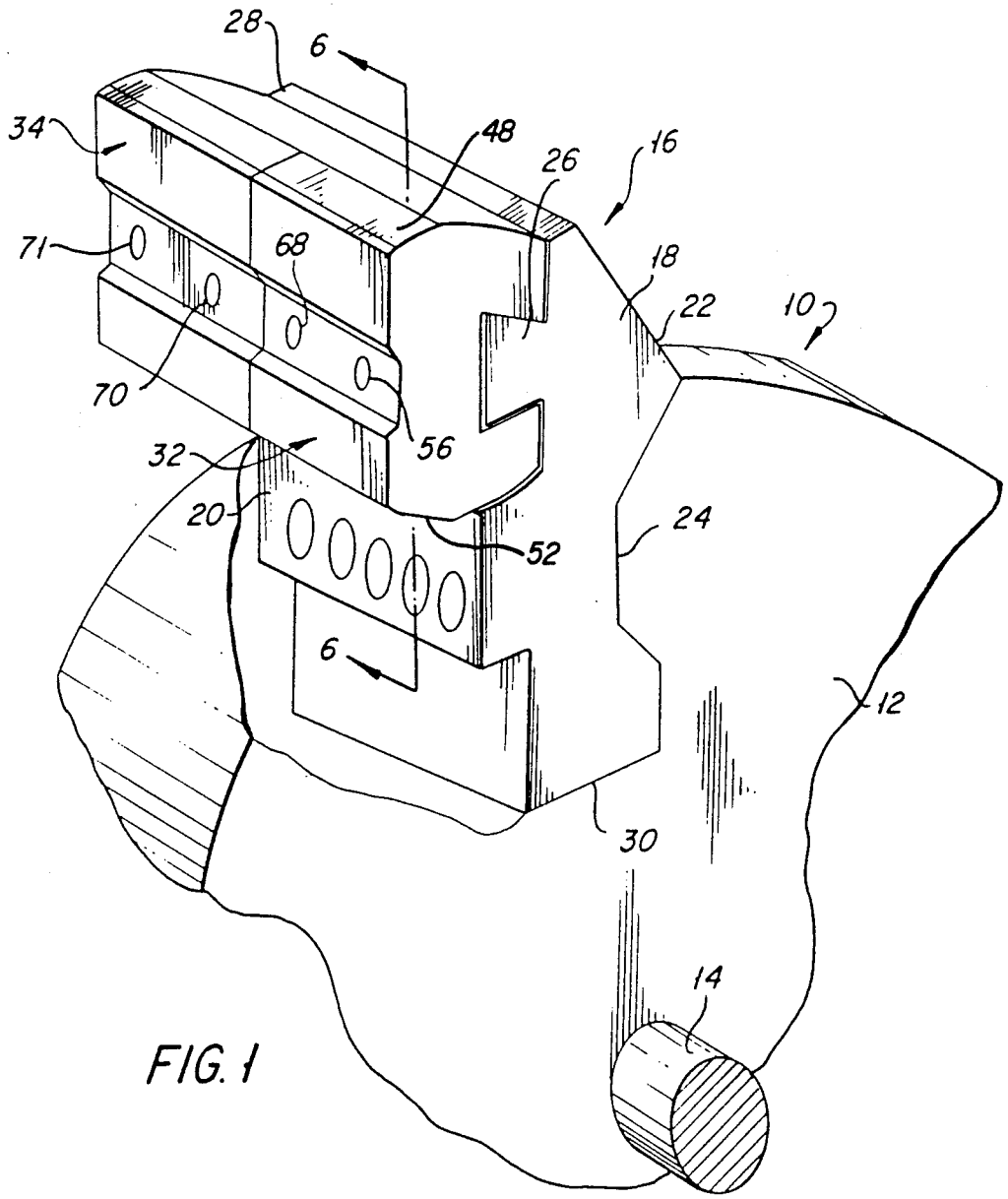
FIG. 1 is a perspective view partially cut away of the hammer assembly for attachment to a rotor of a rotary material crusher according to the present invention.

FIG. 1 is a perspective view of a rotary material crusher generally designated 10. The rotary material crusher 10 includes a rotor 12 mounted on a shaft 14. A hammer assembly generally designated 16 is rigidly mounted adjacent the periphery of the rotor 12. The hammer assembly 16 includes an extension 18, which is rigidly connected to the rotor 12 by means of a plurality of fastening bolts to be described hereinafter. The extension 18 has a front face 20 and a rear face 22. The rear face 22 of the extension 18 defines a longitudinal channel 24 which extends parallel to the axis of rotation of the rotor 12. The longitudinal channel 24 cooperates with a correspondingly-shaped protrusion formed on the rotor 12, such that the extension 18 may be located and correctly oriented relative the rotor 12. The front face 20 of the extension 18 includes a dovetail-shaped extension or extending projection 26. The dovetail extension 26 extends longitudinally along the front face 20 of extension 18 and extends parallel to the axis of rotation of the rotor 12. The extension 18 further includes a top face 28 and a bottom face 30. As shown in FIG. 1, the longitudinal channel 24 is located near the bottom face 30, and the dovetail extension 26 is located near the top face 28 of extension 18. A cap generally designated 32 having a first hard face 48 (FIG. 6) is secured adjacent extension 18 near the top face 28 of extension 18. A second hard face 52 of the cap is also disposed adjacent the top face 28 of extension 18 and in side-by-side relationship relative the first hard face 32.

Figure 2:
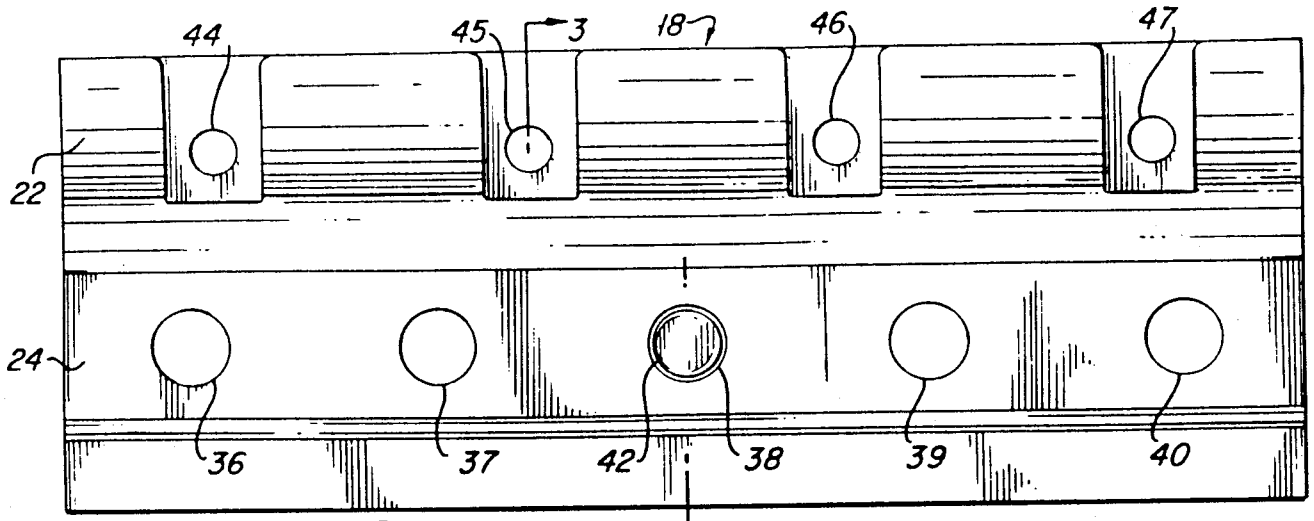
FIG. 2 is a rear elevational view of the hammer member according to the present invention.

FIG. 2 is a rear elevational view of extension 18 showing the rear face 22 of extension 18. The channel 24 as shown in FIG. 2 defines five equally-spaced first bores 36, 37, 38, 39 and 40. Fastening means including threaded bolts, one of which is shown in FIG. 2 and designated 42 extends through the first bore 38 and threadably engages a corresponding threaded bore in the rotor 12 to secure extension 18 the rotor 12.

Figure 3:
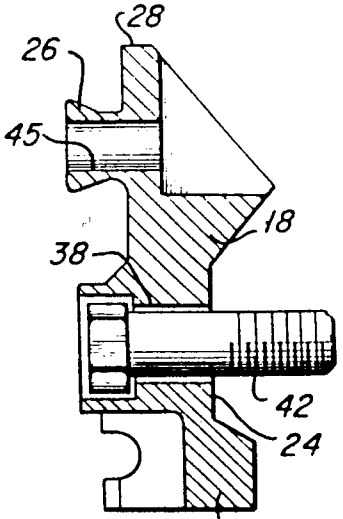
FIG. 3 is a sectional view taken on the line 3—3 of FIG. 2.

FIG. 3 is a sectional view of extension 18 taken on the line 3—3 of FIG. 2 and shows the longitudinal channel 24 and the bolt 42 extending through the first bore 38. FIG. 3 also shows the dovetail-shaped extension 26. FIG. 2 shows four second bores 44, 45, 46, and 47 which extend through extension 18 and the dovetail-shaped extension 26. FIG. 3 shows the second bore 45 extending through extension 18 and the extension 26.

Figure 4:
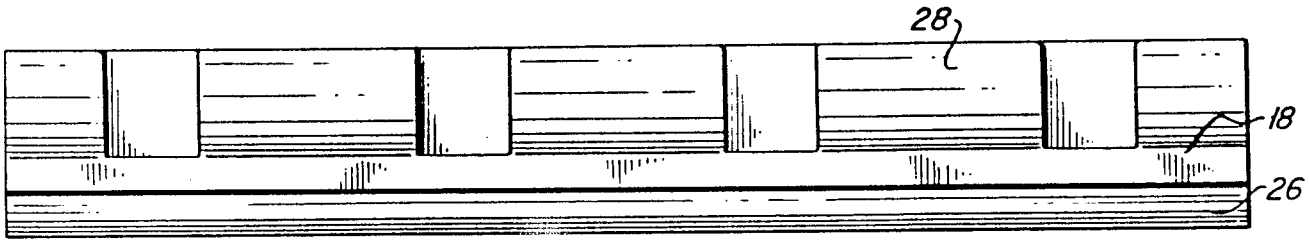
FIG. 4 is a top plan view of the hammer member as shown in FIG. 3.

FIG.4 is a top plan view of extension 18 showing the top face 28 and the dovetail-shaped extension 26.

Figure 5:
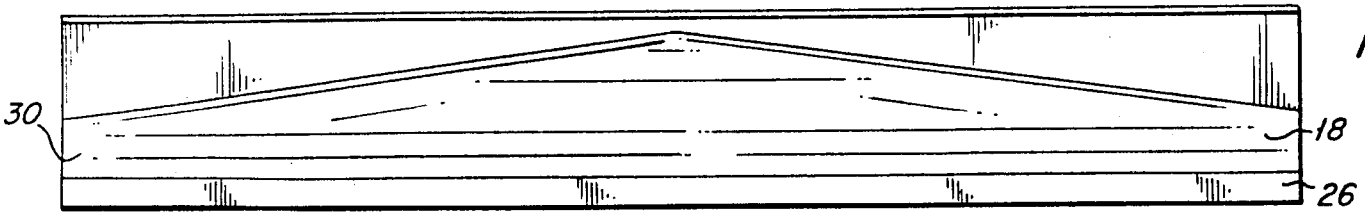
FIG. 5 is a bottom plan view of the hammer member as shown in FIG. 3.

FIG. 5 is a bottom plan view of extension 18 showing the bottom face 30 and the dovetail 26.

Figure 6:
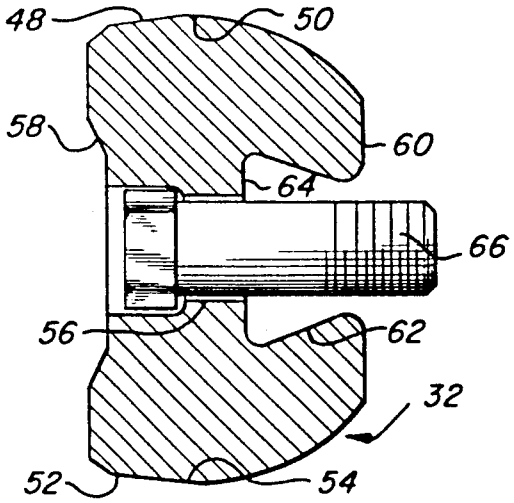
FIG. 6 is an enlarged sectional view taken on the line 6—6 of FIG. 1 showing the cap.

FIG. 6 is an enlarged sectional view taken on the line 6—6 of FIG. 1 and shows the cap. The cap 32 includes a first hard face 48 which extends longitudinally along a first portion 50 of the outer surface of the cap 32, the first portion 50 of the outer surface being disposed parallel relative the axis of rotation of the rotor 12. A second hard face 52 extends longitudinally along a second portion 54 of the outer surface of the cap, the second portion being disposed parallel relative the axis of rotation of the rotor. The first and the second hard faces 48 and 52, respectively, are disposed on opposite sides of the cap 32, and a third bore 56 disposed midway between the hard faces 48 and 52 extends through the cap 32. The cap 32 includes a leading face 58 and a trailing face 60. The trailing face 60 defines a undercut portion 62 of dovetail-shaped configuration, the undercut portion 62 being of slightly greater dimensions than the external dimensions of the dove tail extension 26 of extension 18. The undercut portion 62 extends longitudinally along the length of cap 32 such that the extension 26 and the undercut portion 62 may cooperate together to lock cap 32 relative the hammer member 18. The third bore 56 extends from the leading face 58 of the first cap 32 towards the base 64 of the undercut portion 62. A second fastening means shown in FIG. 6 as a threaded bolt 66 extends through the third bore 56 and engages and extends through the second bore 44 of extension 18. The bolt 66 engages a nut (not shown) such that the cap 32 may be securely fastened to extension 18. The second and third bores 44 and 56, respectively, have a longitudinal axis substantially disposed tangentially relative the axis of rotation of the rotor 12.

Figure 7:
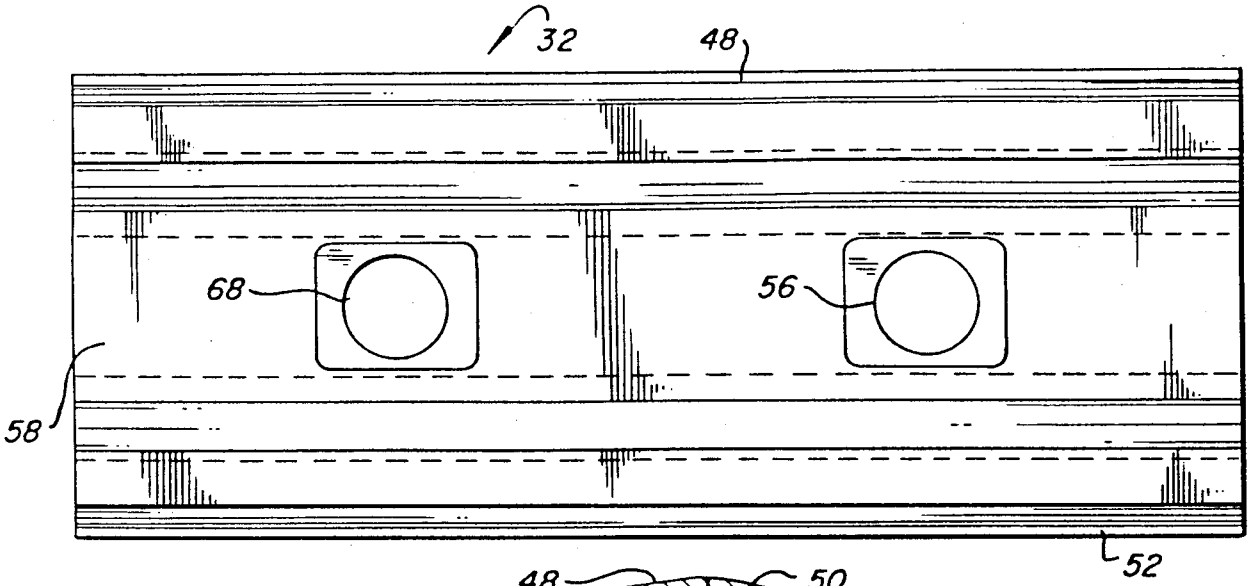
FIG. 7 is a front elevational view of one of the caps when viewed from the leading side.

FIG. 7 is a front view of the 32 and shows the leading face 58 of cap 32. The cap 32 includes two third bores designated 56 and 68, respectively, and the first and second hard faces 48 and 52, respectively, are disposed at substantially equal distances from the third bores 56 and 68, respectively.

In operation of the rotary material crusher 10 when the shaft 14 is rotated, the rotor 12 will rotate in a counterclockwise direction when viewed as showed in FIG. 1, and the first hard face 48 of the cap 32 will react with and crush material fed into the rotary material crusher. After a period of operation, due to the abrasive and wear-imparting characteristics of the material to be crushed, the hard face 48 will become worn. When such wear has taken place, the rotary material crusher is shut down and the second fastening means, including bolt 66 fastening cap 32 to extension 18 are released. The cap 32 is slid laterally to disengage the same from the dove tail extension 26, and the cap is oriented through 180° and slid longitudinally along the dove tail extension 26 such that the second hard face 52 is disposed in the position previously occupied by the first hard face. The bolts 66 are once again inserted through the third bores 56, 68, 70 and 71, respectively, and cap 32 is securely fastened to extension 18 and the material crusher will once again be ready for operational use.

The reversible cap of the present invention not only provide a means for rapidly replacing the hard face for continued reaction with the material to be crushed, but also halves the cost of such a wear-compensating operation, because rather than having to replace the cap as has been the case with the prior art machines, the operator merely has to orientate the positions of the respective hard faces. Furthermore, in the prior art replaceable caps it has been necessary to remove the caps tangentially relative the hammer member, and this has often necessitated a maintenance operator climbing into the rotor housing in order to remove the caps from the hammer arm. With the present invention, in view of the fact that many conventional rotary material crushers have a side access door disposed adjacent the side of the hammer member, it is possible for the maintenance operator to release the cap fastening means and to slide the caps longitudinally sideways relative the hammer member and orientate the same relative the hammer member, thereby avoiding the necessity of the maintenance operator working in a potentially dangerous environment.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A hammer assembly for attachment to the rotor of a rotary material crusher, said rotor being rotatable about an axis of rotation, said hammer assembly comprising in combination: a hammer member for rigid connection to the rotor of said material crusher, said hammer member having an extension, said extension having a longitudinal axis parallel with and spaced from said axis of rotation of said rotor when said hammer member is mounted on said rotor, said extension having a uniform crosssectional configuration along the length of said extension, a plurality of first bores, each of said first bores extending through said extension and having a longitudinal axis extending substantially perpendicular to said extension within said extension, a cap means removably mounted on said extension for impacting and crushing material on rotation of said rotor, said cap means having an undercut portion which cooperates with a dove tail on said extension for locking said cap means on said extension, a plurality of second bores through said cap means transverse to said cap means, each of said second bores having a longitudinal axis substantially parallel to said first bores when said cap means is mounted on said extension, said second bores being aligned with third bores extending through said dove tail of said extension, first and second hard faces on said cap means with an undercut portion between said hard faces; and fastening means extending through each of said second and third bores for fastening said cap means to said extension, said undercut portion, said dove tail, said first and second hard faces and said fastening means being symmetrical and enabling said cap means to be removed from and relocated on said extension in a reversed position for selectively positioning said first and said second hard faces of said cap means on said extension for crushing material upon use of said hammer assembly on a rotor of a rotary material crusher.

2. A hammer assembly as claimed in claim 1, wherein said hammer member is provided with a longitudinal channel having a longitudinal axis extending parallel to said axis of rotation of the rotor.

3. A hammer assembly as claimed in claim 2, wherein said cap means extends from a front face of said extension and said longitudinal channel is provided on a rear face of said extension.

4. A hammer assembly as claimed in claim 3, wherein said cap means is disposed at a greater radial distance from said axis of rotation of said rotor than is said longitudinal channel.

5. A hammer assembly as claimed in claim 1 or claim 2, wherein each of said second bores is disposed substantially midway between said first and said second hard faces so that when said cap means is rotated through 180° about the longitudinal axes of said first and said second plurality of bores the positions occupied by said first and said second hard faces relative said extension are interchanged.

6. A hammer assembly as claimed in claim 1, wherein said undercut portion on said cap means is of the same general transverse cross-sectional configuration as said dove tail on said extension but of slightly greater dimensions so that said cap means may be slid longitudinally relative to said extension to slide said cap means into locking engagement with said extension.

7. A hammer assembly as claimed in claim 6, wherein a pair of said cap means cooperate with each of said hammer members, each of said cap means being installed by sliding said cap means longitudinally and parallel relative to the axis of rotation of said rotor.

* * * * *